US007637374B2

(12) United States Patent
Fried

(10) Patent No.: US 7,637,374 B2
(45) Date of Patent: Dec. 29, 2009

(54) ROTATING EGG CONTAINER

(76) Inventor: Brian A. Fried, 9 Richbourne La., Melville, NY (US) 11747

( * ) Notice: Subject to any disclaimer, the term of this patent is extended or adjusted under 35 U.S.C. 154(b) by 137 days.

(21) Appl. No.: 12/046,367

(22) Filed: Mar. 11, 2008

(65) Prior Publication Data

US 2008/0223748 A1 Sep. 18, 2008

Related U.S. Application Data

(60) Provisional application No. 60/894,716, filed on Mar. 14, 2007.

(51) Int. Cl.

| | |
|---|---|
| ***B65D 81/02*** | (2006.01) |
| ***B65D 85/00*** | (2006.01) |
| ***A01K 29/00*** | (2006.01) |
| ***G07F 11/26*** | (2006.01) |

(52) U.S. Cl. ..... 206/521.1; 99/500; 119/6.8; 220/508; 426/110; 426/115; 221/76

(58) Field of Classification Search ... 206/521.1–521.9; 220/507, 508; 99/485–486, 498–500, 568; 426/110–120, 231, 298–299; 221/76, 79
See application file for complete search history.

(56) References Cited

U.S. PATENT DOCUMENTS

| | | | | | |
|---|---|---|---|---|---|
| 2,521,907 | A | * | 9/1950 | Gill | 99/500 |
| 2,923,631 | A | * | 2/1960 | Kauffman et al. | 426/299 |
| 4,057,145 | A | * | 11/1977 | Wray et al. | 220/525 |
| 4,941,570 | A | * | 7/1990 | Kruger et al. | 221/91 |
| 5,617,782 | A | * | 4/1997 | Thomas | 99/500 |
| 5,858,434 | A | * | 1/1999 | Thomas | 426/299 |

* cited by examiner

*Primary Examiner*—Bryon P Gehman
(74) *Attorney, Agent, or Firm*—Jeffrey D. Lindsay

(57) ABSTRACT

A rotating egg container is disclosed having a body and an internal rotating unit for storing a plurality of eggs. The internal rotating unit has a plurality of egg holding sections joined to two opposing tracks defining a pathway through which the egg holding sections can be moved.

25 Claims, 5 Drawing Sheets

ROTATING EGG CONTAINER

CLAIM TO PRIORITY

This application claims priority to U.S. Patent Appl. Ser. No. 60/894,716, "Rotating Egg Tray," filed Mar. 14, 2007, hereby incorporated by reference in its entirety for all purposes.

BACKGROUND

1. Field of the Invention

The present invention pertains to the field of food storage devices and systems, particularly for the storage of eggs in cooled food storage spaces.

2. Discussion of Related Art

Many containers for eggs have been proposed, including the ubiquitous foam-based and paperboard egg cartons, plastic egg holders in refrigerator units, and a variety of rigid egg trays. Examples include those described in U.S. Pat. No. 2,188,044, "Egg Tray," issued to R. N. Hickman, Jan. 23, 1940; U.S. Pat. No. 2,438,443, "Egg Tray for Refrigerators," issued to A. C. Jermyn Mar. 23, 1948; and U.S. Pat. No. 5,102,034, "Egg Container," issued to A. Arnabili, Apr. 7, 1992, and D210,613, issued Aug. 14, 1967 to R. G. Moore.

In spite of the many products offered, there remains an unmet need for storage containers that can make efficient use of space, particularly in refrigerators where users frequently struggle to find adequate space to store and organize various items. Previous devices such as portable durable egg containers with covers often require that the user remove the entire container from a cooled storage space in order to remove even one egg, or provide sufficient clearance above the egg container to be able to remove a cover or lid that spans the entire length of the container in order to remove a single egg. Further, containers commonly provided for eggs often are unable to bear significant weight, making them unsuitable for routine stacking of other items thereupon. These and other limitations of the prior art have resulted in unmet user needs regarding efficient and convenient egg storage and removal systems. The various embodiments of the invention described below may individually address one or more of such needs or problems, but it is to be understood that not all prior problems herein noted need be addressed in any one embodiment of the invention as defined by the claims below.

SUMMARY OF THE INVENTION

A rotating egg container has been developed having a body and an internal rotating unit for storing a plurality of eggs. The internal rotating unit has a plurality of egg holding sections joined to two opposing tracks defining a pathway through which the egg holding sections can be moved.

The rotating egg container in general comprises a body that houses the internal rotating egg storage unit, wherein a plurality of egg holding sections are rotatably connected to opposing pairs of spaced apart, movable linkages in two respective opposing continuous tracks wherein each track defines a pathway generally oriented in a vertical plane (when, for example, the egg container is resting on a horizontal surface), wherein each egg holding section can pivot about its own horizontal pivot axis to maintain a relatively constant orientation relative to the horizontal plane throughout the entire circuit of motion over the continuous track such that an egg sitting in an egg seat within an egg holding section remains in an orientation that prevents it from falling. The pathway defined by the tracks determines the path of motion of the egg holding sections during rotation, and this pathway may have at least two substantially horizontal tiers, such that when eggs are loaded into the egg seats of the egg holding sections, a plurality of eggs are located in at least two substantially horizontal tiers.

The egg container has two opposing outer walls with continuous track surfaces on the opposed inner sides to provide a track runway to hold movable linkages therein. Each track may receive a movable element such as a flexible belt or cord with spaced apart connections to receive the movable linkages, wherein the flexible belt or cord can be pulled through the track. Alternatively, the tracks may receive ball bearings or other freely rotating elements that can be used to space apart the movable linkages that are joined to the egg seats and permit low-friction motion through the track runway. The runway may be open or partially enclosed, such a having a shoulder, to restrain the movable elements in the track runway while still permitting linkages to extend from the spaced apart connections in the runway to the egg seats.

In a sense, the motion of the egg seats during the course of a circuit through the internal rotating unit is similar to that of a Ferris wheel seat, which can rotate relative to coupling to the wheel itself to allow passengers to remain in a safe orientation during the course of the wheel's motion. But instead of human passengers, the egg seats of the present invention are adapted to receive eggs to allow them to be stored in an egg container.

Thus, in one aspect of the invention, the rotating egg container comprises a body having an openable cover and two opposing side walls, each side wall comprising a track housing holding a movable element in a continuous track, the egg container further comprising a rotating egg storage unit disposed within the body comprising a plurality of egg holding sections each having one or more egg seats for seating an egg and a pair of opposing connecting members extending outwardly from the egg holding section, wherein each connecting member rotatably engages one of the movable elements in the respective continuous tracks, such that force applied to the egg holding sections or to a movable element can cause rotation of the egg holding sections within the egg container along a path defined by the continuous tracks.

In another aspect of the invention, the egg container comprises a body that encloses an interior chamber, the body having two opposing walls, an openable cover, and at least one stationary joining element fixedly joining the opposing walls, the side walls each comprising a recessed track housing open to the interior holding a movable element therein, the tracks each defining a common circuitous pathway along which the respective movable elements may travel in response to force applied to the movable elements by a user, the movable elements providing a plurality of spaced apart movable linkages, the egg container further comprising a plurality of movable egg holding sections, each egg holding section comprising one or more egg seats for receiving an egg and comprising two opposing connecting members extending outwardly from the egg holding section along a pivot axis, the opposing connecting members each engaging a respective movable linkage in the tracks of the opposing walls, wherein the egg holding section can freely pivot relative to the movable elements about the pivot axis to maintain an egg in a substantially upright position in the egg seat during motion of the movable elements through the circuitous pathway. The pivot axis can be substantially above the center of gravity of the egg holding section both in the unloaded state and when loaded with a typical egg (e.g., a chicken egg graded as "small," "medium," or "large").

The outer walls can also provide strength and rigidity to the egg container such that it can withstand a considerable load placed on its upper surface (e.g., 5 pounds or more, or at least 10, 15, or 25 pounds), thus permitting stacking of other objects on the egg container in a refrigerator. To facilitate stacking, an upper surface of the egg container may be substantially flat and horizontal when the egg container is resting on a horizontal shelf. The egg container may also be adapted to securely engage similar egg containers in a stack of two or more egg containers of the present invention. Such adaptations may include feet that can engage depressions on the upper surfaces of an underlying egg container.

The container may further have a front closure that can be opened to extract one or more eggs or to load eggs, if desired. With the front closure open, the user may manually rotate the internal rotating unit to bring egg holding sections from the rear or lower portions of the container into reach at the front. The front closure may open in any direction such as to the front, to the sides, etc., or may receded, roll, or fold into a portion of the egg container.

Rotation of the movable elements in the respective tracks can be done by pushing or pulling individual egg seats. In some embodiments, an external rotating element such as a knob may be present on an exterior side surface to allow the user to rotate the internal rotating unit to bring eggs into a desired position, or to bring empty egg seats forward for reloading. Tabs or other grippable elements extending from the movable elements may also protrude from interior openings of the track housing for one or both tracks to allow a user to grasp a tab or other grippable element and apply force to move that tab in a desired direction along the track to move the movable element and thus cause rotation of the internal rotating unit, as desired.

The movable elements in the two opposing tracks can remain in registration through the connectivity between the two provided by the egg holding sections or by other means, including additional spindles, gears, or other mechanisms linking motion between the two movable elements.

The egg container may further comprise a top cover that can be opened to allow for rapid restocking of eggs or for cleaning of the interior.

The egg container when viewed from the side may be substantially rectangular in cross section, or rounded rectangular, elliptical, flattened elliptical, circular, and the like.

The egg container may also be provided with means for stacking a plurality of units on top of one another to store a large number of eggs over a small footprint of occupied shelf space.

A given egg seat may be adapted to hold one or more eggs, such as two or more, three or more, and the like. The egg containers of the present invention may be adapted to hold any number of eggs when full, such as six, ten, twelve, fourteen, eighteen, twenty-four, thirty, and so forth, such as six or more, twelve or more, eighteen or more, and the like. Eggs of any size may be considered, and need not be restricted to chicken eggs, but may also include eggs of many other species. Generally, however, the eggs should not be so large that they cannot be seated stably in the egg seats of the egg holder units.

The egg container may be constructed of any suitable material, such as thermosetting or thermoplastic polymers, metal, wood, glass, composite materials, and the like. Suitable polymeric materials may include ABS, polycarbonate, polyvinyl chloride, polypropylene, polyethylene, nylon, silicone polymers, etc. The body may be opaque or may comprise transparent sections, such as a see-through front cover, top cover, or side windows. Manufacturing of the various components of the egg container may be by any known method such as injection molding, ultrasonic welding, casting, machine tooling, stamping, die cutting, thermoforming, rapid prototyping, laser curing, etc.

During assembly, the movable elements may be placed in the tracks of the track housing and, if desired, tightened to maintain tension. Tightening may be done, for example, through the use of a small ferrule or other material that could be crimped in order to maintain the tension in a cord or belt. Alternatively, a heat-shrinkable material may be a component in the movable element, such that heat from an IR lamp, hot air blower, oven, etc., can be briefly applied to cause the movable element to achieve the desired amount of tension in the track.

DETAILED DESCRIPTION

Figure 1:
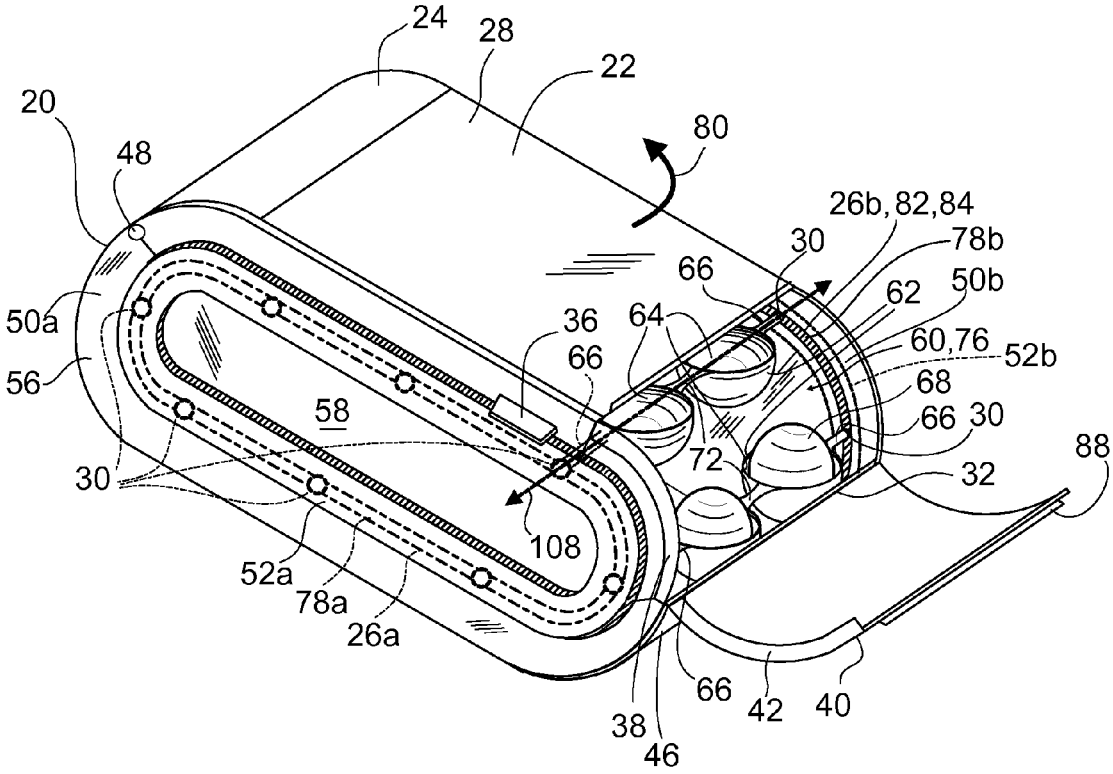
FIG. 1 depicts a perspective view of one embodiment of the egg container of the present invention in an open state.

FIG. 1 depicts an egg container 20 comprising a body 22 enclosing an internal chamber 60 having an internal rotating egg storage system 76 capable of storing a plurality of eggs 68. The eggs 68 are seated in movable egg holding sections 62 comprising concave egg seats 64 adapted to hold an egg 68 in place. While each egg holding section 62 may comprise one or more egg seats 64, the embodiment shown has two egg seats 64 joined by a bridge 72 and disposed between opposed pairs of connecting members 66 that are rotatably connected to movable linkages 30 associated with movable elements 78*a*, 78*b* retained in opposing tracks 26*a*, 26*b*, respectively attached to the side walls 50*a*, 50*b*, respectively of the body 22. In alternative embodiments not shown, the egg holding sections 62 may each have three, four, five, or more egg seats 64. The egg container 20 may comprise any number of egg holding sections 62. While the egg container 20 in FIG. 1 has 8 egg holding sections 62 capable of holding 16 eggs, fewer or more egg holding sections 62 may be used, such as any number greater than four, more specifically from about five to about sixteen, or from six to ten. The egg container 20 may hold any of the following numbers of eggs or more: 10, 12, 18, 20, 24, 30, 36, 48, 60, 90, etc., though for typical domestic refrigerators, from about 12 to about 24 may a specific range suitable for many user needs.

On the side walls 50*a*, 50*b*, tracks 26*a*, 26*b* are retained within track housings 52*a*, 52*b*, respectively. As can be seen on exterior wall 50*a*, the track housing 52*a* in this embodiment protrudes from the surface of the side wall 50*a*, and as can be seen on the opposing second side wall 50*b*, the tack housing 52*b* provides a recessed region 82 that receives second track 26*b*, wherein an opening 84 in the interior wall 50*b* provides access for the connecting members extending laterally from the egg holding sections 62 to be connected to the movable element 78*b* in track 26*b*, while the opening 84 is not so large as to permit the movable element 78*b* to fall away from the track housing 52*b* (in other words, it provides a shoulder or other restraining means to secure track 26*b* within the housing 52*b*). A similar opening (not shown) is also provided in the interior surface (not shown) of the first side wall 50*a*.

The egg holding sections 62 can move in a circuitous pathway defined by tracks 78*a*, 78*b*. During the circuit of motion, the egg seats 64 maintain their vertical orientation, at least when an egg 68 is seated therein. The center of gravity of the egg seat 64 is below the horizontal pivot axis 108 defined by the connecting members 66 for each respectively egg holding section 62, and the center of gravity for the egg seat 64 while holding a suitable egg 68 will also be below the horizontal pivot axis 108. Since the egg holding sections 62 can pivot relative to the movable elements 78*a*, 78*b* in the tracks 26*a*, 26*b* through the coupling to the movable linkages 30, rotation of the egg holding sections 62 is enabled to thereby maintain the proper orientation of the egg seats 64 and thus prevent unseating of the egg 68. The pivoting of the egg holding sections 62 relative to the movable elements 78*a*, 78*b* can be due to rotary motion of the connecting members 66 relative to the movable linkages 30, or due to rotary motion of the movable linkages 30 relative to the movable elements 78*a*, 78*b*. For example, when the movable elements 78*a*, 78*b* are belts such as a rubber or silicone belt, or are interconnected chain elements such as a chain of plastic links (not shown) with pivots (not shown) joining each end of each link to an adjacent link, the movable linkage 30 may be a cylindrical seat or opening in the movable elements (i.e., the belt or chain) that can receive a rounded end or pin (not shown) of a connecting member 66, allowing the connecting member 66 to freely pivot relative to the movable linkage 30. In another embodiment, the movable elements 78*a*, 78*b* may be a flexible cord such as a steel cable, nylon twine, or any other monofilament or multifilament cable. In another embodiment, the movable linkage 30 may include a linkage body such as a cylindrical shell (not shown) and a freely rotating internal seat (not shown) that connects to the end of the connecting member 66, allowing the movable element 30 (or a part thereof) to freely pivot or rotate relative to the movable element 30. In another embodiment, the movable elements 78*a*, 78*b* can be a series of non-connected ball bearings or other movable elements that are retained within the tracks 26*a*, 26*b*, and in this case, the movable linkage 30 may simply be a cylindrical end of the connecting member 66 that can slide through its respectively track 26*a*, 26*b* without undue friction, with the motion of one egg holding section 62 inducing motion of the other egg holding sections 62 via force transmitted through the series of ball bearings (not shown) serving as the movable elements 78*a*, 78*b* in the tracks 26*a*, 26*b*, respectively.

The movable elements 78*a*, 78*b* may also have a plurality of protruding tabs (not shown) that project out of the tracks 26*a*, 26*b* to allow a user to grasp them and advance the position of the movable elements 78*a*, 78*b* in the pathway defined by the tracks 26*a*, 26*b*.

Track housings 52*a*, 52*b* need not protrude from the exterior surfaces of the side walls 50*a*, 50*b*, as shown, but may protrude from the inner surfaces or protrude from both surfaces, or may be disposed between two substantially parallel flat or curved surfaces (i.e., a thick hollow wall), such that the presence of the track housings 52*a*, 52*b* and the circuitous path of the tracks 26*a*, 26*b* are not obvious based on viewing the exterior of the body 22.

In addition to track housings 52*a*, 52*b*, the outer walls 50*a*, 50*b* may comprise an inner section 58 within the circuit of the track housings 52*a*, 52*b*, and an outer section 56 outside the circuit of the track housings 52*a*, 52*b*.

Each track housing 52*a*, 52*b* defines the path of the respectively track 26*a*, 26*b* and retains the movable element 78*a*, 78*b*, respectively, while providing internal clearance to allow the movable elements 78*a*, 78*b* to be connected to the connecting members 66 of the egg holding sections 62.

The body 22 of the egg container 20 in embodiments related to FIG. 1 also comprises an upper cover 28 with a curved rear portion 24 and a hinge element 48 that can allow the upper cover 28 to be opened for ease of loading the egg container 20 with eggs 68 or for cleaning, when desired. Alternatively, the upper cover may be completely removed and may simply snap into and out of place, when desired, without the need for a hinge element 48. Lifting or removal of the upper cover can be facilitated by the presence of one or more tabs 36, such as the side tab 36 shown here (an opposing side tab 36 may be on the opposing side of the egg container 20, but is not shown). Opening of the upper cover 28 via the tabs 36 or other means can be then be in the direction shown by arrow 80, toward the rear of the body 22. The upper cover 28 may be substantially greater in surface area and in length than the front cover 40, though it may also be approximately equal in length or shorter.

The body can also have a lower surface 46, which may have feet (not shown) such as silicone or rubber feet for securely seating the egg container 20 on a glass shelf in a refrigerator (not shown) or other surface.

The rear portion 24, the lower surface 46, or the hinge elements 32, 48 may serve as relatively stationary joining elements that fixedly connect the opposing side walls 50*a*, 50*b*.

The egg container 20 in FIG. 1 is shown in an open state to reveal the internal rotating egg storage system 76 that comprises the movable elements 78*a*, 78*b* in the tracks 26*a*, 26*b*, the plurality of egg holding sections 62 movably associated with the movable elements 78*a*, 78*b*, etc. The open state is provided by opening the front cover 40 which is attached to the body 22 via a hinge mechanism 32, and which has a lip 88 for opening. The lip 88 may snap shut against the body 22, or side panels 42 may engage front sides 38 of the body 22 to snap shut during closing.

Figure 2:
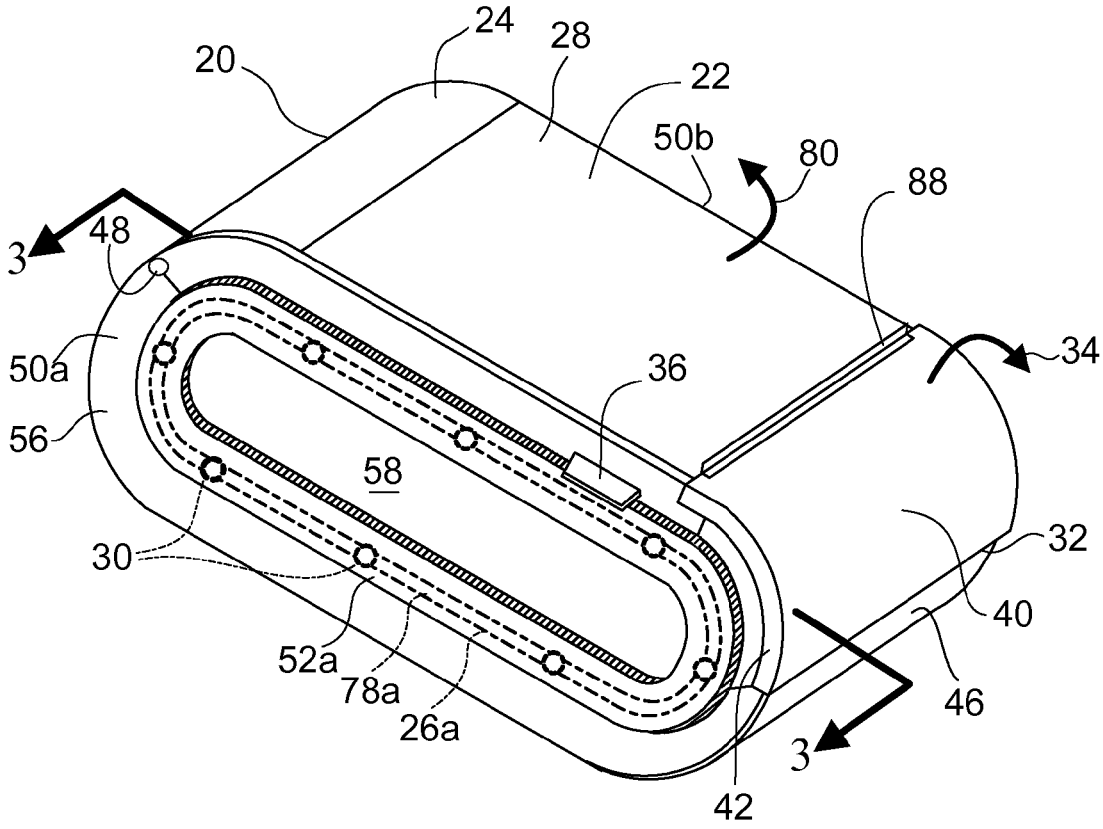
FIG. 2 depicts a perspective view of one embodiment of the egg container of the present invention in a closed state.

FIG. 2 shows the egg container 20 of FIG. 1 in a closed state, with the front cover 40 closed against the body 22. The front cover 40 can be opening by grasping the lip 88 and pulling to open the cover in the direction shown by arrow 34.

Figure 3:
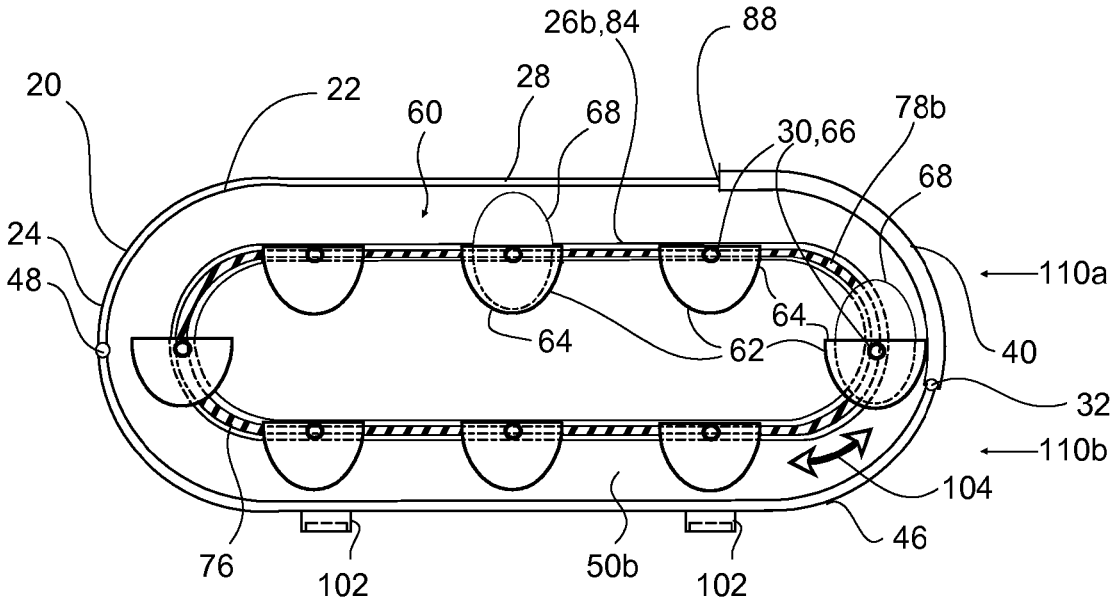
FIG. 3 depicts a side view of the egg container.

FIG. 3 shows a cross-sectional view from the side of the egg container 20 of FIG. 2, with the first side wall 50*a* removed, as well as the associated first track 26*a* and first movable element 78*a* also removed for clarity. Eggs 68 can be seen seated upright in egg seats 64 of egg holding sections 62 which can pivot about a pivot axis (not shown) normal to the plane of the figure passing through the connecting members 66 for each egg holding section 62. The connecting members terminate in a movable linkage 30. Movable element 78*b* is visible in track 26*b* through the opening 84 in side wall 50*b*.

The internal rotating egg storage system 76 can rotate in either direction shown by arrow 104.

Also shown are feet 102 on which the egg container 20 may rest.

In this embodiment, two tiers 110*a* and 110*b* can be defined, representing two layers of eggs that are present one above the other. Eggs at either end of the internal rotating egg storage system 76 (substantially all of the moving components inside the body 22) can be considered as being between the two tiers 110*a*, 110*b*.

Figure 4:
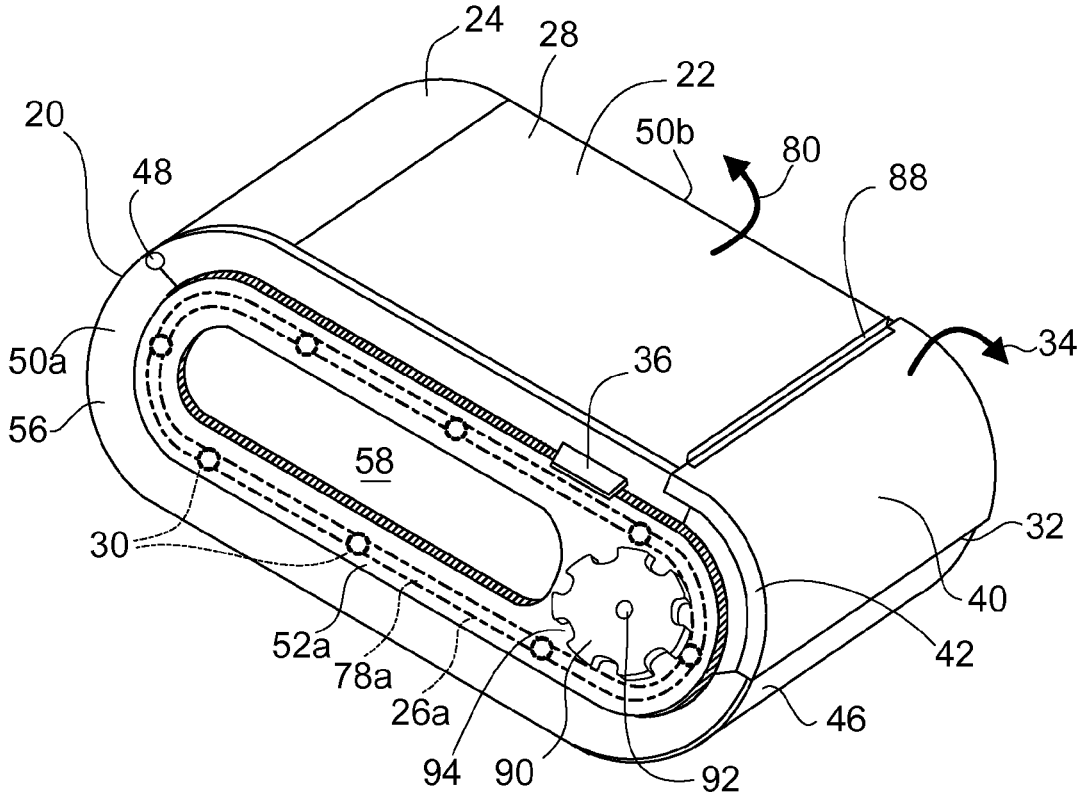
FIG. 4 depicts a perspective view of one embodiment of the egg container showing an external knob for controlling motion of the internal rotating egg storage system.

FIG. 4 shows an egg container 20 similar to that of FIG. 1, but having an external knob 90 that may be turned by the user to advance the movable elements 78*a*, 78*b* in tracks 26*a*, 26*b*, respectively. The knob 90 can rotate a pivot 92 that can drive the motion of the movable elements 78*a,* 78*b* through any known engaging mechanism (not shown) such as radial teeth that engage the movable elements 78*a,* 78*b,* a gear mechanism, a wheel over which the movable element 78*a* passes (e.g., similar to a belt drive when the movable element 78*a* is a belt or continuous band or cord), other forms of frictional engagement, a ratchet mechanism, a pinion system, etc., all of which are known in the art. The knob 90 may be adapted to only drive the movable elements 78*a,* 78*b* when it is depressed or slid into a position (not shown) to engage a gear mechanism, such that the knob 90 is not forced to turn when a user moves the egg holder units (not shown) inside the body, allowing the knob 90 to be disengaged therefrom except when a user wishes to use the knob 90 to advance the movable elements 78*a,* 78*b.* The knob 90 is located over the track housing 52*a,* which has been modified relative to FIGS. 1 and 2 through the presence of an extended forward end 94 to also house the engaging mechanism (not shown) to drive the movable element 78*a* via the turning of the knob 90.

A single knob 90 may be present or opposing knobs (not shown) on each of the side walls 50*a,* 50*b* may be present. When two knobs are present, they may be connected with a common axis (not shown) extending through the body 22 but without interfering with the passage of eggs (not shown) during motion of the internal rotating unit (not shown). Alternatively, the knobs may not be directly connected one to another but may be driven synchronously through the mechanical interaction of other linkages between the two movable elements 78*a,* 78*b* (referring to FIG. 2 for movable element 78*b*), such as by coupling provided by the egg holding sections (not shown) that connect the opposing movable elements 78*a,* 78*b.*

Figure 5:
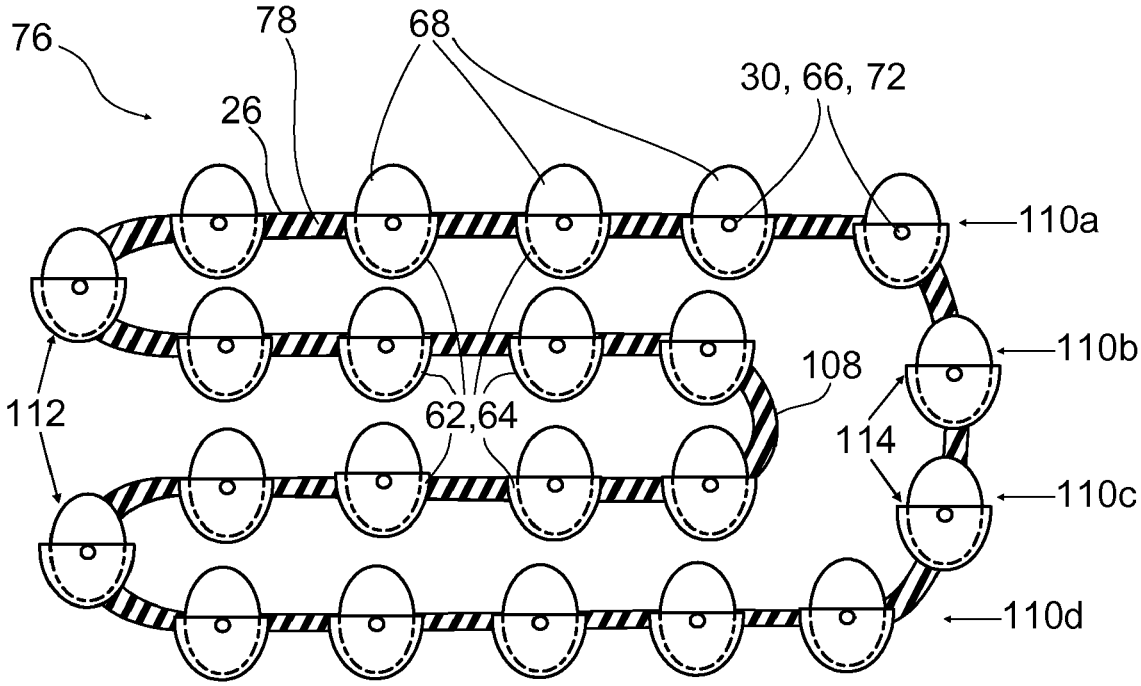
FIG. 5 is a schematic of an alternative configuration of the path of a sinuous runway and multiple egg seats holding eggs.

FIG. 5 depicts an alternate embodiment for an internal rotating egg storage system 76, in which a sinuous track 26 (only one track being shown) defines a sinuous pathway 108 for the movable element therein 78, providing four tiers 110*a,* 110*b,* 110*c,* 110*d* in which eggs 58 can be movably stored in egg holding sections 62 (eggs 68 are also in some intermediate positions 112, 114 as well). The egg holding sections 62, as before, comprise two or more egg seats 64, bridges 72 between the egg seats 64 in each egg holding section 62, and connecting members 66 connected to movable linkages 30 that engage the movable elements 78 (only one of which is shown). In the cross-sectional view shown, for each egg holding section 62, the connecting members 66, bridge or bridges 72, and movable linkages 30 all overlap and are represented with a single circle, though it is to be understand that several components are present both in front of and behind the visible egg seat 64.

Many other related sinuous paths can be defined within the scope of the present invention offering two, four, six, or more tiers of eggs, providing for increased numbers of eggs that can be stored over a given surface area of storage space in a refrigerated area. For lengthy or highly sinuous pathways, increased friction may be overcome with mechanical drives (not shown) to assist motion of the movable elements, Indeed, manually or automatically activated motorized drives may be included to assist in moving egg holding sections 62 through such pathways 108, if desired, without departing from the scope of the present invention. But embodiments that are purely manually operated and/or that exclude motorized devices are also within the scope of the present invention.

Remarks

When introducing elements of aspects of the invention or the embodiments thereof, the articles "a," "an," "the," and "said" are intended to mean that there are one or more of the elements. The terms "comprising," "including," and "having" are intended to be inclusive and mean that there may be additional elements other than the listed elements.

Having described aspects of the invention in detail, it will be apparent that modifications and variations are possible without departing from the scope of aspects of the invention as defined in the appended claims. As various changes could be made in the above compositions, products, and methods without departing from the scope of aspects of the invention, it is intended that all matter contained in the above description shall be interpreted as illustrative and not in a limiting sense.

While the foregoing description makes reference to particular illustrative embodiments, these examples should not be construed as limitations. The inventive system, methods, and devices can be provided with many additional features and adapted for other uses not explicitly listed above, and can be modified in numerous ways within the spirit of the present disclosure. All elements shown, for example, may be subject to a wide variety of decorative enhancements and variations in shape, texture, as well as the inclusion of various sensors, indicators, and so forth without departing from the scope of the present invention. Thus, the present invention is not limited to the disclosed embodiments, but is to be accorded the widest scope consistent with the claims below.

I claim:

1. An egg container comprising a body having an openable cover and two opposing side walls, each side wall comprising a track housing holding a movable element in a continuous track, the egg container further comprising a rotating egg storage unit disposed within the body comprising a plurality of egg holding sections each having one or more egg seats each for seating an egg and a pair of opposing connecting members extending outwardly from each egg holding section, wherein each connecting member rotatably engages one of the said movable elements in the respective continuous tracks, such that force applied to the egg holding sections or to a movable element can cause rotation of the egg holding sections within the egg container along a path defined by the continuous tracks.

2. The egg container of claim 1, wherein, when the egg container is resting on a horizontal surface, each egg holding section can pivot about a substantially horizontal axis defined by the connecting members, thereby allowing an egg seated in a said egg seat to remain seated without being inverted as the rotating egg storage unit is rotated.

3. The egg container of claim 1, wherein the movable elements are flexible belts or cords.

4. The egg container of claim 3, wherein the movable elements comprise spaced apart openings having curved walls for receiving connecting members of the egg holding sections, the connecting members being substantially cylindrical in the portions thereof that are received by the spaced apart openings.

5. The egg container of claim 1, wherein the movable elements comprise a series of spherical elements adapted to roll within the tracks.

6. The egg container of claim 5, wherein the connecting members are adapted to ride in the tracks of the opposing side walls, with the connecting members of adjacent egg holding sections being spaced apart by the presence of spherical elements in the tracks that space apart the connecting members of adjacent egg holding sections.

7. The egg container of claim 1, wherein the movable elements define a circuitous pathway having two or more substantially horizontal tiers.

8. The egg container of claim 1, wherein the movable elements define a circuitous pathway having more than two substantially horizontal tiers.

9. The egg container of claim 1, wherein the movable elements define a circuitous pathway having a shape selected from a flattened oval, an ellipse, a circle, a rectangle, and a rounded rectangle.

10. The egg container of claim 1, wherein each egg holding section comprises two egg seats, and wherein the egg container comprises six or more egg holding sections.

11. The egg container of claim 1, wherein each egg holding section comprises three or more egg seats.

12. The egg container of claim 1, the body comprising an internal chamber and the egg container further comprising grippable elements extending from at least one of the movable elements into the internal chamber, such that a user can grasp one or more of the grippable elements and apply force thereto to move the movable elements in their respective tracks.

13. The egg container of claim 1, wherein the openable cover is a front cover having a first length, and further comprising a second openable cover having a second length greater than the first length.

14. An egg container comprising a body that encloses an interior chamber, the body having two opposing walls, an openable cover, and at least one stationary joining element fixedly joining the opposing walls, the side walls each comprising a recessed track housing open to the interior and holding a movable element therein, the track housings each defining a circuitous pathway along which the movable elements may travel in response to force applied by a user, the movable elements having a plurality of spaced apart movable linkages, the egg container further comprising a plurality of movable egg holding sections, each egg holding section comprising one or more egg seats each for receiving an egg and comprising two opposing connecting members extending outwardly from the egg holding section along a pivot axis, the opposing connecting members each engaging a respective movable linkage in the track housings of the opposing walls, wherein the egg holding section can freely pivot relative to the movable elements about the pivot axis to maintain an egg in a substantially upright position in its egg seat during motion of the movable elements through the circuitous pathway.

15. The egg container of claim 14, where at least a portion of the body is substantially transparent.

16. The egg container of claim 14, wherein the movable elements are selected from flexible belts and flexible cords.

17. The egg container of claim 16, wherein the moveable elements comprise spaced apart openings having curved walls for receiving connecting members of the egg holding sections, the connecting members being substantially cylindrical in the portions thereof that are received by the spaced apart openings.

18. The egg container of claim 14, wherein the movable elements comprise a series of spherical elements adapted to roll within the track housings.

19. The egg container of claim 14, wherein the circuitous pathway comprises two or more substantially horizontal tiers.

20. The egg container of claim 14, wherein the circuitous pathway comprises greater than two substantially horizontal tiers.

21. The egg container of claim 14, wherein the circuitous pathway has a shape selected from a flattened oval, an ellipse, a circle, a rectangle, and a rounded rectangle.

22. The egg container of claim 14, wherein each egg holding section comprises two egg seats.

23. The egg container of claim 14, further comprising additional means for driving the motion of the movable elements selected from a knob mechanically linked to the movable elements and a motorized drive for moving one or both of the movable elements.

24. The egg container of claim 14, comprising six or more egg holding sections.

25. The egg container of claim 14, wherein the openable cover is a front cover having a first length, the egg container further comprising a second openable cover having a second length greater than the first length.

* * * * *